United States Patent [19]

Jackson

[11] 4,135,613

[45] Jan. 23, 1979

[54] RECORD KEEPING TICKET ISSUING MACHINE

[76] Inventor: Marquis A. Jackson, 60 Martin Pl., Sydney, New South Wales, Australia, 2000

[21] Appl. No.: 758,485

[22] Filed: Jan. 11, 1977

[30] Foreign Application Priority Data

Sep. 27, 1976 [AU] Australia ..... 18136/76

[51] Int. Cl.[2] ..... G07F 11/26

[52] U.S. Cl. ..... 194/2; 194/DIG. 9; 282/13

[58] Field of Search ..... 194/1 R, 2, 9, 10, DIG. 9, 194/DIG. 26; 282/12 R, 12 A, 12 B, 13, 14, 15 R, 15 A, 15 B; 242/75.51

[56] References Cited

U.S. PATENT DOCUMENTS

| | | | |
|---|---|---|---|
| 1,344,909 | 6/1920 | Lederman | 194/DIG. 9 |
| 2,854,116 | 9/1958 | Gray | 194/DIG. 9 |
| 2,946,534 | 7/1960 | Allendorf | 242/75.51 |
| 3,273,914 | 9/1966 | Wagner | 194/10 X |

*Primary Examiner*—Joseph J. Rolla

[57] ABSTRACT

A coin controlled and record keeping ticket issuing machine having a mechanical catch released upon the establishment of a coin credit so as to expose a ticket on which information can be written. The macine has a manually movable device to recover the written-on ticket which is subsequently, automatically issued while a duplicate is wound with other duplicates on a storage spool. The various controls for the mechanisms of the machine are interlocked and arranged so that each sequence of the machine must be completed before the subsequent sequence can take place in the process of issuing a ticket.

5 Claims, 10 Drawing Figures

A
N
"SOLD OUT"
CABINET LIGHTS

RECORD KEEPING TICKET ISSUING MACHINE

This invention has been devised to provide a vending machine in which a coin credit can be established to initiate certain operations ultimately resulting in the vending of a ticket from a supply of preprinted tickets from the machine.

Such a machine, mechanically operated is known, see Australian Pat. No. 433,883 accepted Mar. 19, 1973 for A Coin Controlled and Record Keeping Ticket Issuing Machine.

Machines made according to Pat. No. 433,883 had several drawbacks and because of the many interacting mechanical linkages and parts were not reliable in extended service, were heavy to operate (all functions being controlled by a single handle) and were expensive to manufacture because of the many mechanical components which had to be made and it was almost impossible to build in safeguards to avoid or at least detect operational malfunctions.

The present invention whilst paralleling the invention of my earlier patent in object and result incorporates means which ensure reliability in service, ease of operation and a reliable, fail-safe sequential functioning of components. To this end the machine of this invention incorporates means initiated by the establishment of the coin credit to uncover a ticket (with duplicate) upon which information can be written and manually initiated, means to recover the ticket and in so doing initiate further operations, to cause the written-on ticket to be issued and the duplicate to be s means in the machine.

Thus the present invention specifically provides a coin controlled and record keeping ticket issuing machine comprising a housing in which is a coin credit establishing means, with associated release means activated by the establishment of the coin credit to move a slide from its normal position covering a support surface for tickets to be written on to a position exposing said support surface and at the same time create power circuits for feed means and ticket severing means to be subsequently energized, manual means on the housing to return the slide to its normal position, first control means activated by the returning of the slide to its normal position to temporarily activate said feed means to advance a strip laminate of original and duplicate tickets in order to locate a new ticket with duplicate over said support surface and locate the preceding now written on original ticket in operative relationship to a ticket severing and issuing means, second control means activated by the completion of the ticket advancing operation of the feed means to sever and issue said preceding original ticket and third control means activated by slack in the advancing strip of duplicate tickets to temporarily activate a duplicate ticket storage means.

Figure 1:
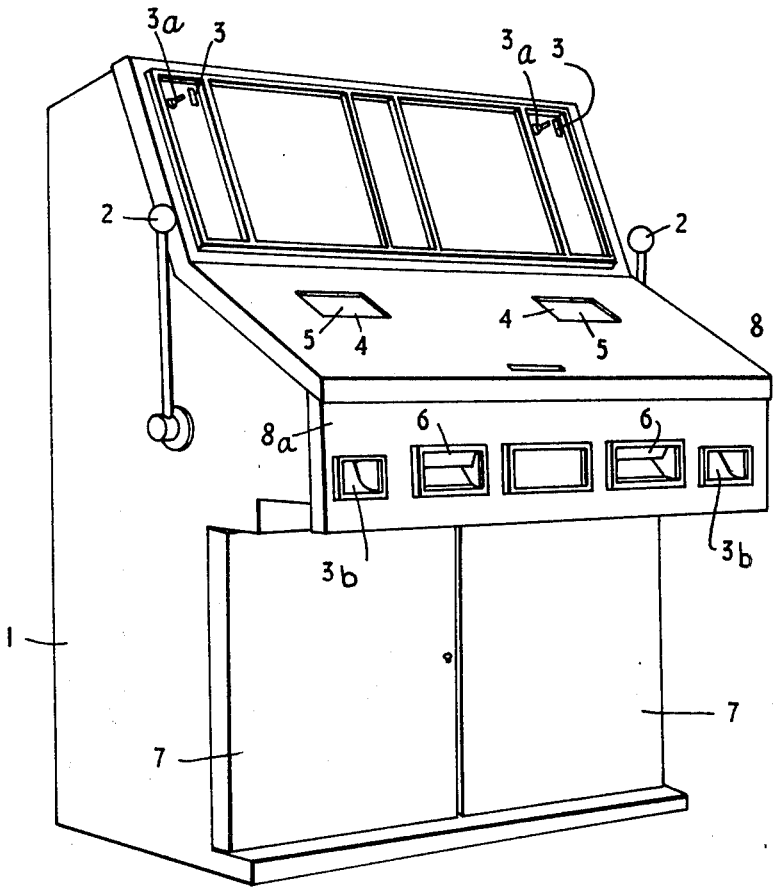
Figure 2:
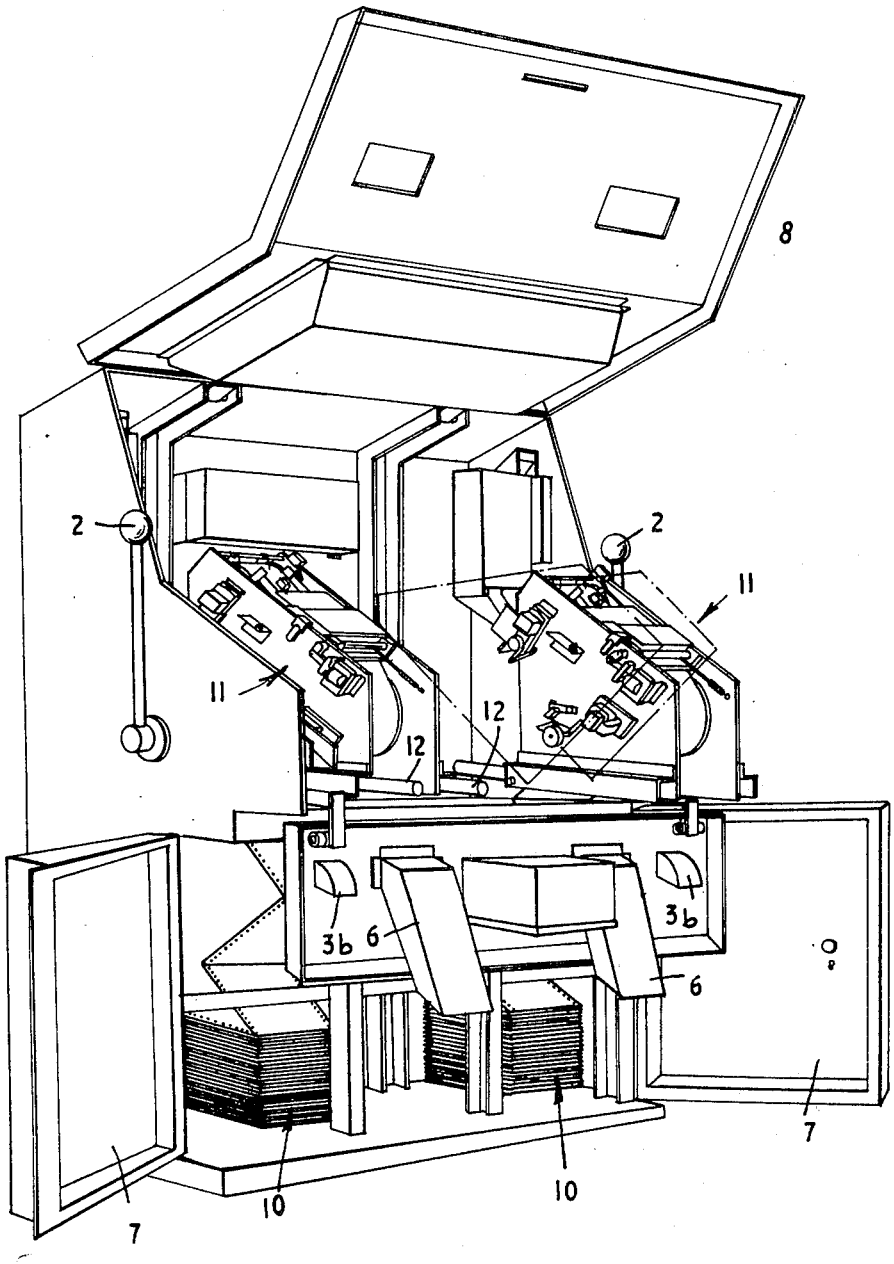
Figure 3:
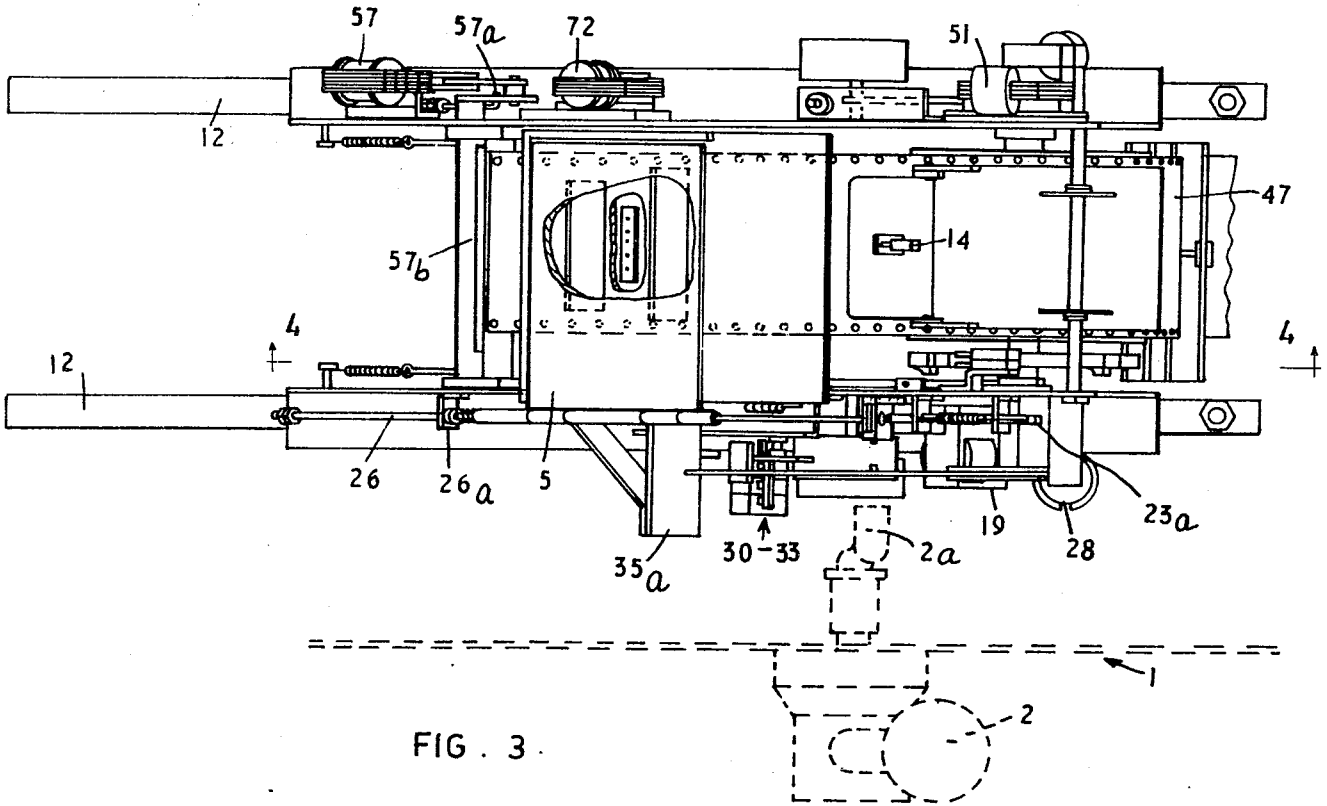
Figure 4:
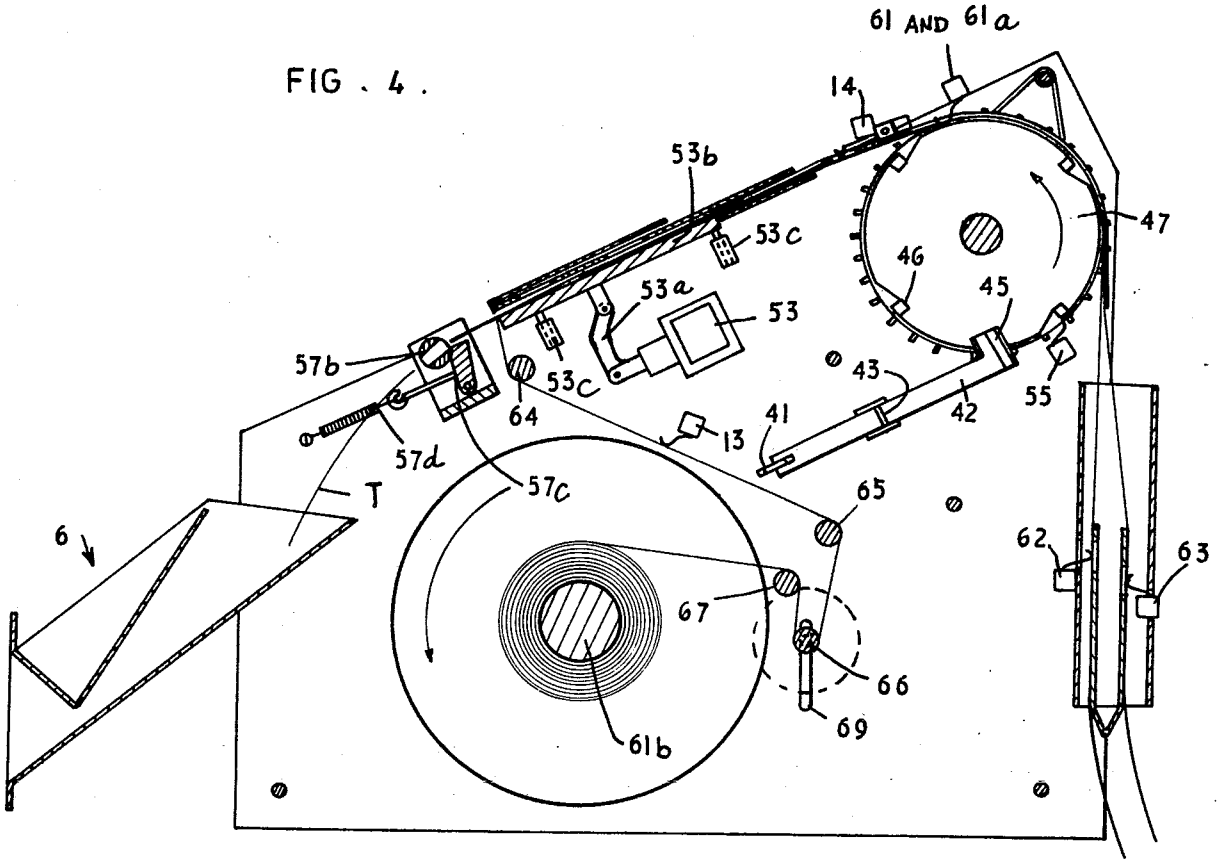
Figure 5:
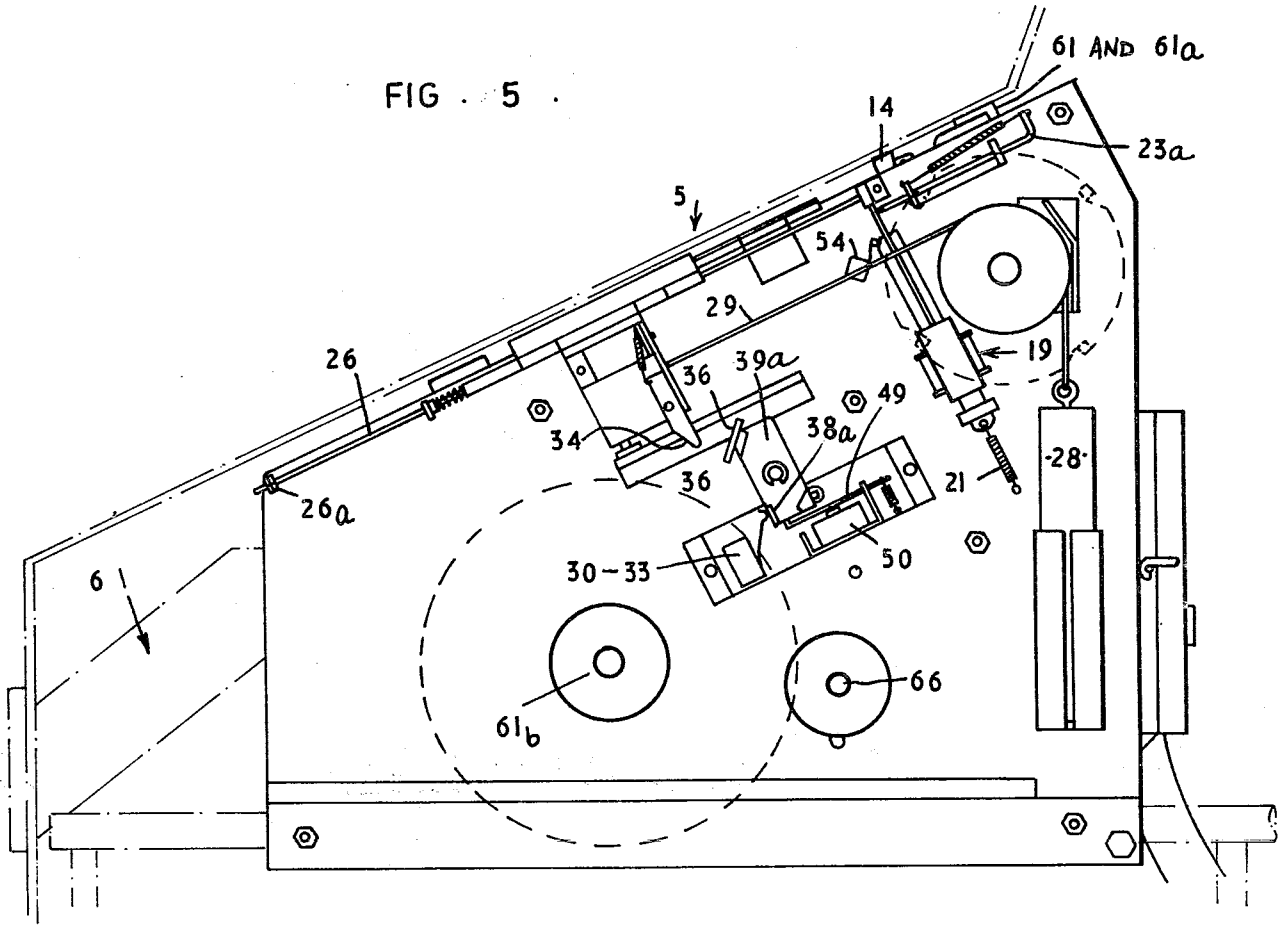
Figure 6:
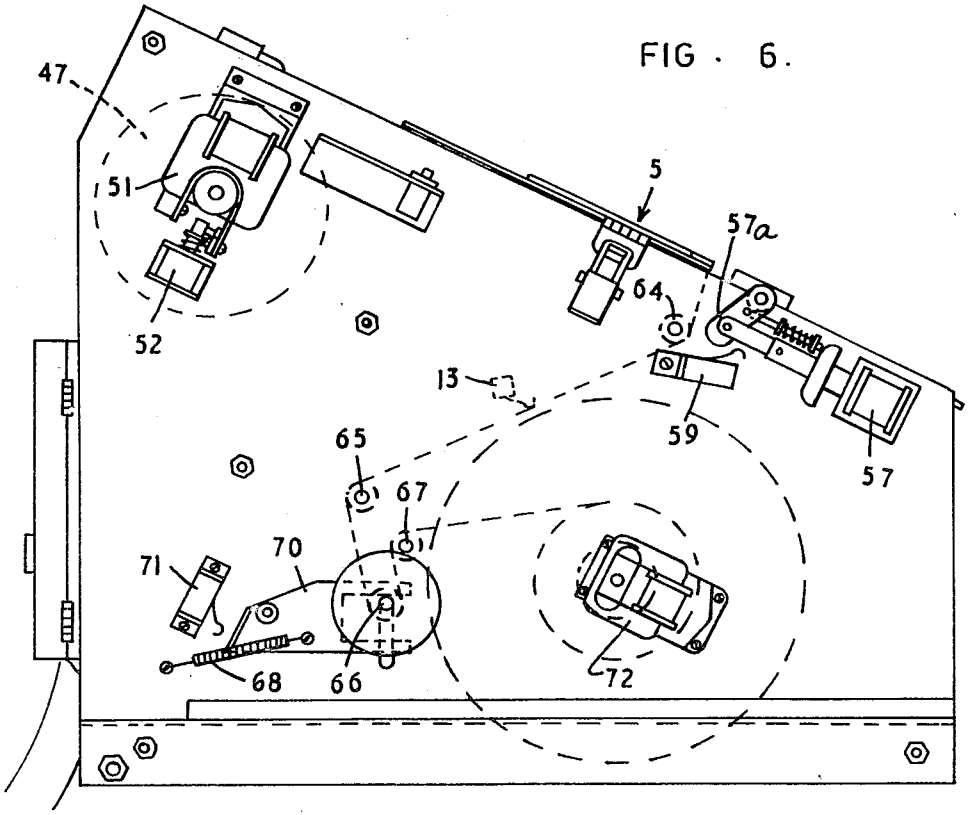
Figure 7:
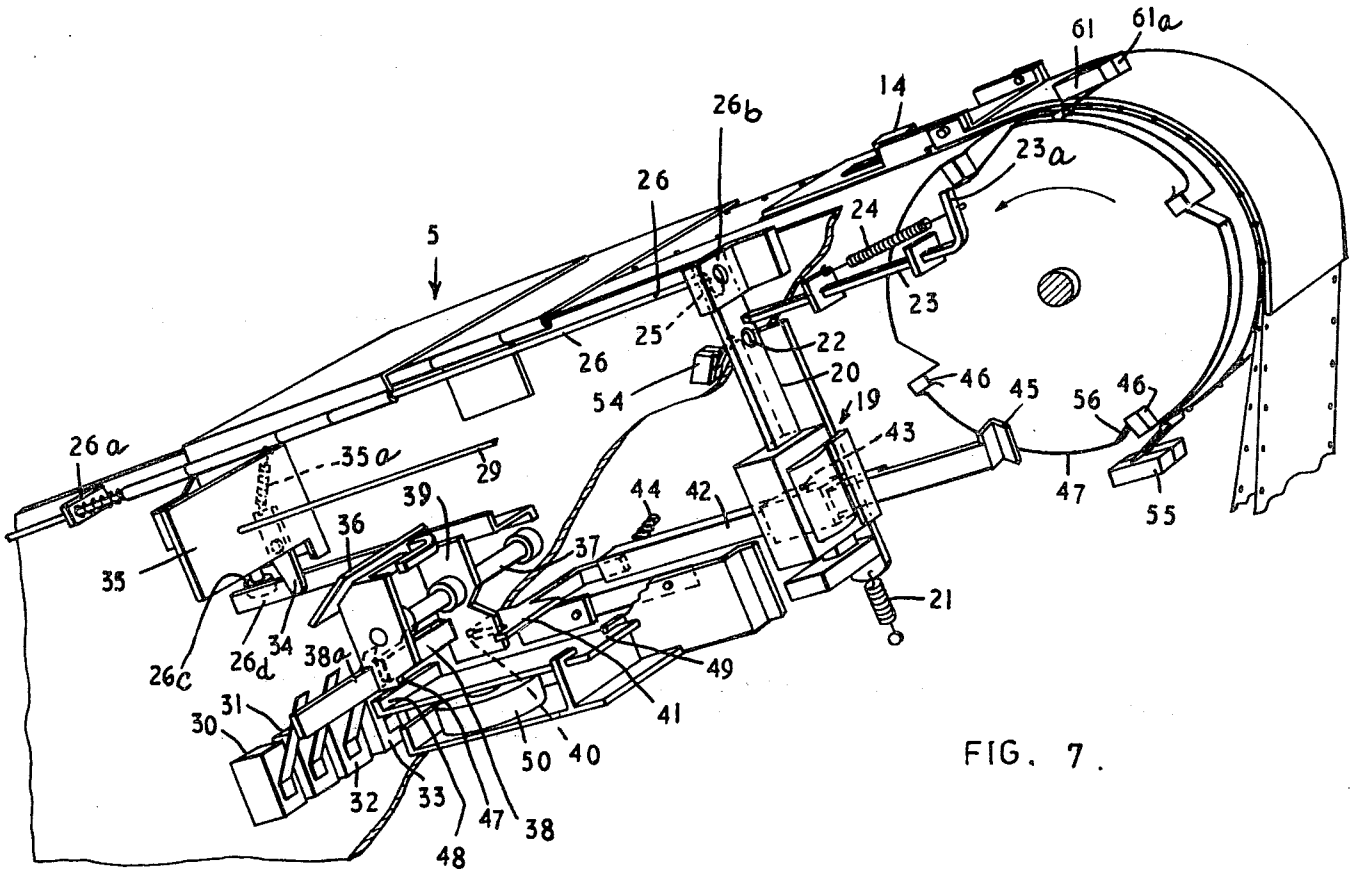
Figure 8:
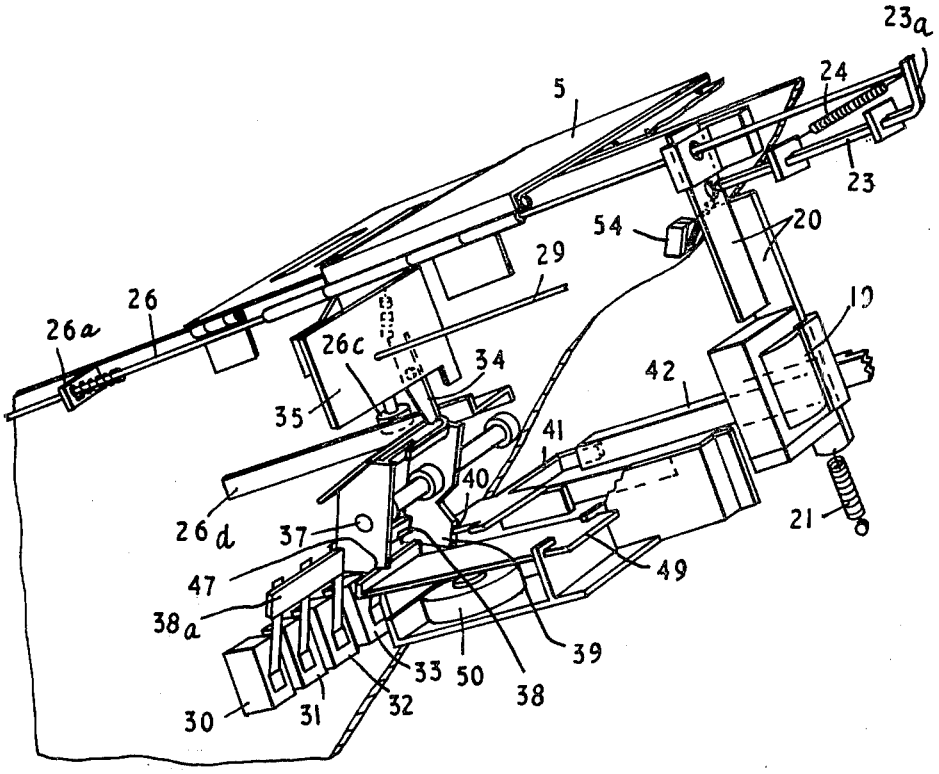
Figure 9:
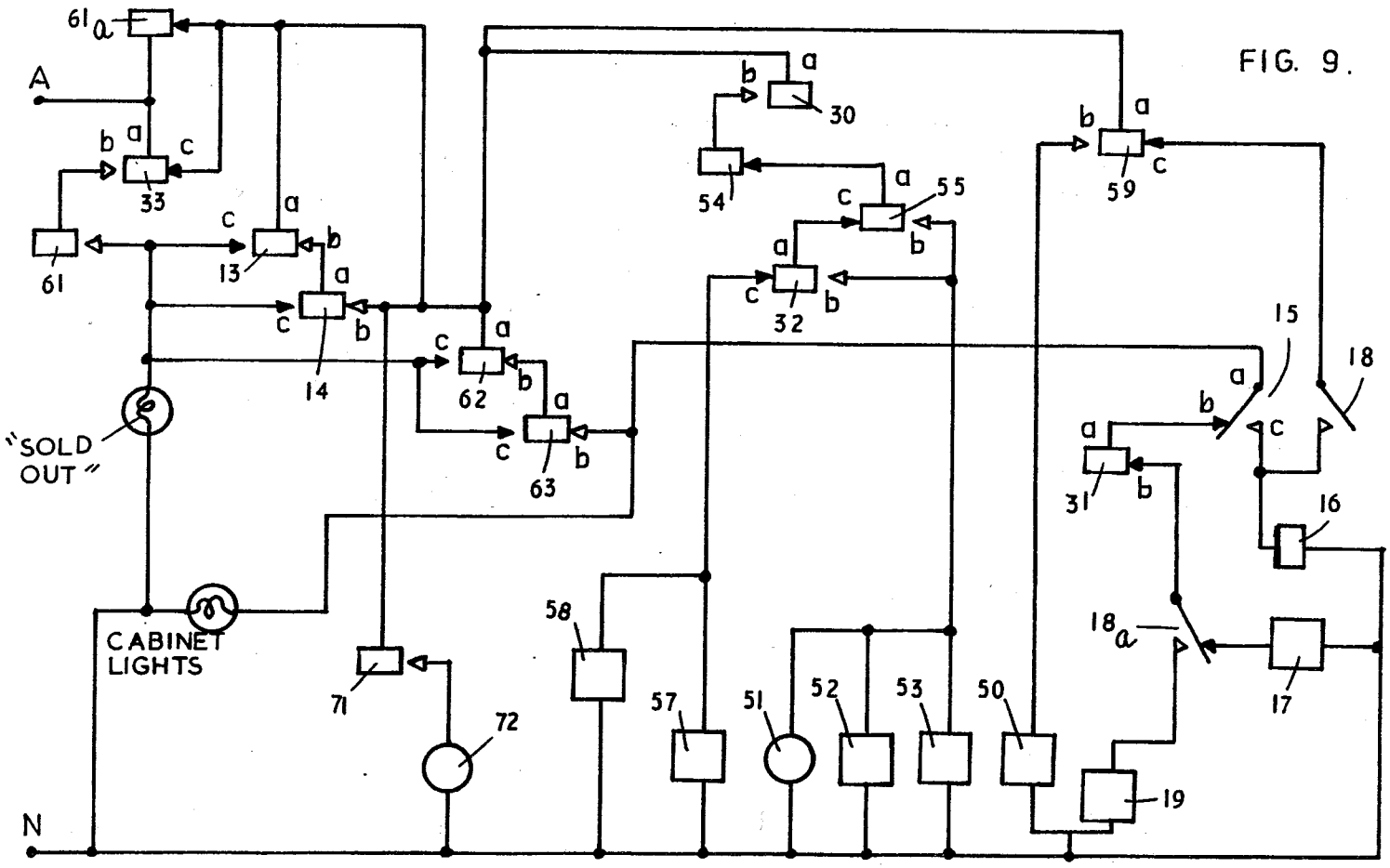
Figure 10:
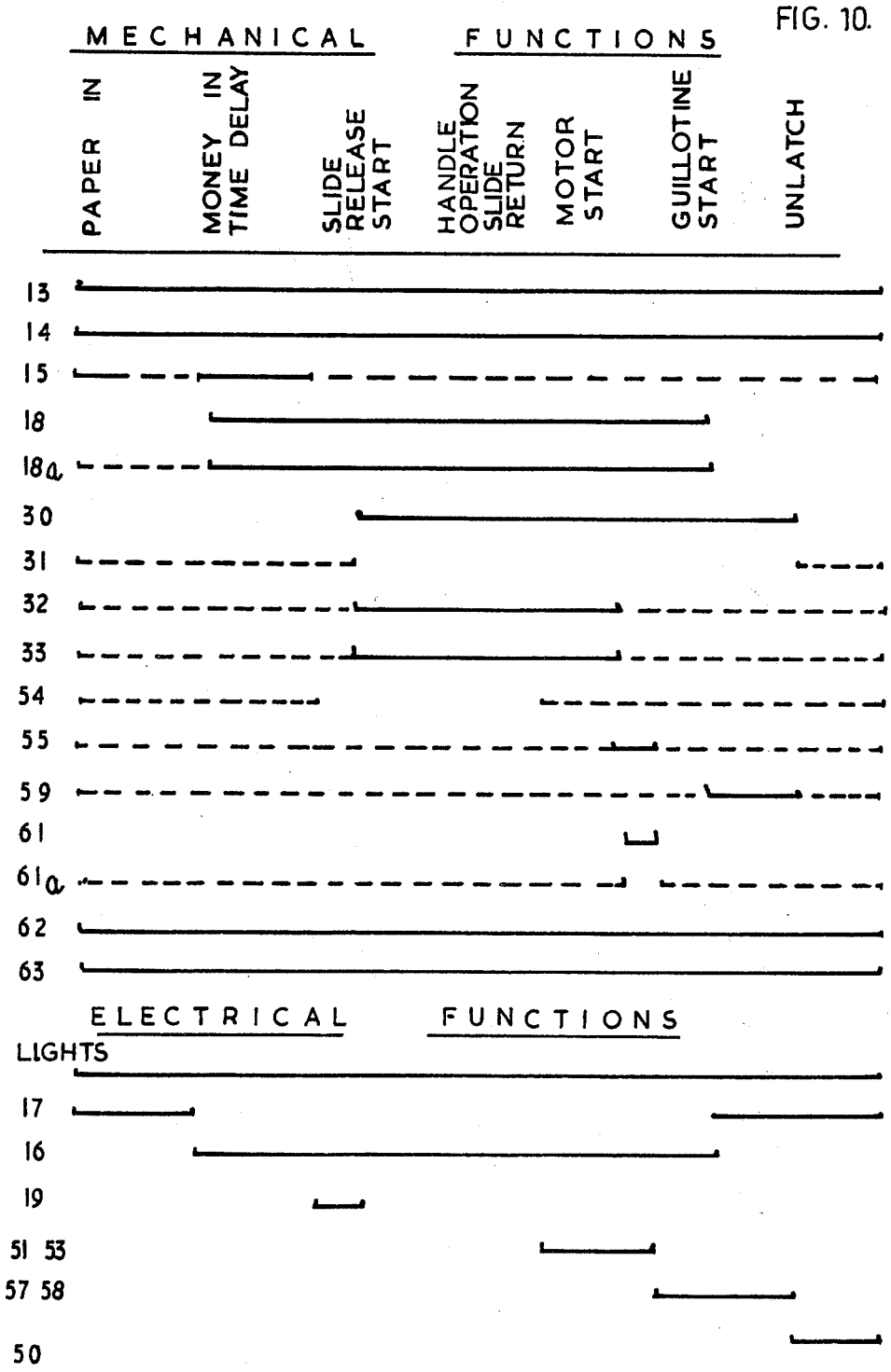

The invention in a presently preferred form will now be described with reference to the accompanying drawings in which:

FIG. 1 is a front perspective view of the machine,

FIG. 2 is a view similar to FIG. 1 with covers raised to expose the machine parts, FIG. 3 is a view from above of a ticket feeding and severing mechanism of the machine, FIG. 4 is a sectional view of section line 4—4 of FIG. 3, FIG. 5 is a side view of the mechanism of FIG. 3, FIG. 6 is a view of the other side of the mechanism of FIG. 3, FIG. 7 is a fragmentary perspective view of the mechanism of FIG. 3, FIG. 8 is an enlarged fragmentary perspective view of portions of the mechanism of FIG. 3, FIG. 9 is a circuit diagram, and FIG. 10 is a mechanical function and electrical function against time graphical analysis of the machine operation.

The machine as illustrated is a duplex machine comprising a housing 1 having two operating handles 2 which are operable in a manner to be described when a coin credit is established by depositing appropriate coinage in the coin slot 3 of coin release mechanisms which are associated one with each handle. Coin return buttons **3*a* and chutes 3*b* are also provided. Apertures 4 allow access to tickets to be written upon when slide covers 5 move aside. Subsequent to writing on the tickets other mechanisms result in the slide covers returning and the written on tickets being issued through openings 6. Doors 7 give access to the interior of the machine in order to release locking means (not shown) which retains cover 8 and cover extension 8*a* closed. When cover 8 is raised it is possible to service the mechanisms within the machine and place bulk ticket supplies in the machine and at the same time to remove cash from the machine. The cover 8 and the door 7 are normally locked to prevent interference with the mechanisms within the machine and to avoid illegal removal of cash. The primary mechanisms of the machine are mainly visible in FIG. 2. These mechanisms include the coin credit establishing means inidicated 9, the sliding covers 5, the bulk ticket storage area 10 for a string of duplex original and duplicate tickets and a mechanism including original ticket severing and issuing means 11. For convenience the mechanisms are removable to facilitate maintenance and installation, this is achieved by mounting the mechanisms as a unit on rails indicated 12 access to which is obtained by folding down the cover portion 8*a***.

The operation of the machine will be described with reference to a single set of mechanisms and ticket issuing means and the operational sequence is best followed from the circuit diagram FIG. 9. The operational steps will be described with reference to the circuit diagram with digressions from the diagram to consider the mechanical components of the machine with which the various electrical components are associated. Referring now to the circuit diagram FIG. 9, the active and neutral leads A and N are respectively connected to the several electrical components of the machine. At this stage it is to be noted that switches 14 and 13 (see FIGS. 4 and 5) which are referred to immediately hereafter respectively monitor the feed of original duplicate tickets to the window 4 of the machine and monitor the rewind of duplicates for storage. A mis-feed at either location will cause the associated switch to interrupt power supplies to the machine mechanisms and a "SOLD OUT" sign to illuminate. The sequence of operations following the connection of power to the machine with the switches 13 held opened and 14 is in its normal position by the proper positioning of the paper feeds is as follows. The cabinet lights of the machine light up to indicate that the machine is ready for operation and power is also provided to a solenoid 17 which holds a deflect finger (not shown) out of the path of coins fed to the device 9. The deflect finger under certain circumstances is allowed to deflect coins away from the device 9 and return them to a user through a chute 3*b*. The coin credit establishing means 9 in so far as its mechanical aspects is not part of this invention and therefore no detailed description will be given. In so far as its electrical aspects this device includes a self cancelling time delay relay having a contact 15 which is switched over upon the insertion of the correct value of coins into the coin credit means. Contact 15 when switched over from terminal b to terminal c closes the circuit of a relay 16. Operation of relay 16 causes switch 18 to close in a self-locking circuit so that when contact 15 returns to terminal b there is still power to the relay 16. Switch 18*a* is switched over by the operation of relay 16 and disconnects the solenoid 17 at the same time preparing a circuit for a solenoid 19 which circuit is completed when contact 15 returns to terminal b after a predetermined time delay.

Turning now to the mechanical aspects of the machine and looking at FIG. 7, operation of solenoid 19 causes a bar 20 to rise against the action of a spring 21 to open a circuit switch 54. The movement of bar 20 locates a hole 22 in bar 20 in line with a plunger 23 which enters hole 22 under the influence of a spring 24. A hole 25 in bar 20 is at the same time aligned with bar 26 of the slide 5. The bar 26 enters hole 25 as the slide 5 moves under the influence of a counter-weight 28 (see FIG. 5) coupled by a rope 29 to a bracket 35 on the slide 5. The bar 26 supports the slide 5 in bearings 26*a* and 26*b* and stability of the slide 5 is maintained by means of the runner 26*c* which engages in a track 26*d*. Bar 20 remains raised bearing on bar 26 when the plunger 23 is subsequently withdrawn from the hole 22 by the end of the bar 26 engaging against lug 23*a* of plunger 23. The hole 25 is sufficiently large so that when plunger 23 is removed and the bar 20 retracts under the pressure of spring 21 the hole 22 is misaligned with the plunger 23 thereby preventing re-entry.

Movement of the slide 5 causes switches 30, 32 and 33 (see FIG. 7) to be mechanically moved to change over terminals and the switch 31 is opened. The switches 30 to 33 are best shown in FIGS. 7 and 8. The switches are mechanically operated by the engagement of a finger 34 with an inclined plate 36. This finger is pivotally mounted on the plate 35 of slide 5 and is spring biassed by spring 35*a* to engage the plate 35. The plate 36 is part of a pivoted assembly which includes leg 39 which is fixed to plate 36 and a leg 39*a*. The legs 39 and 39*a* are rotatably mounted on a shaft 37. Bar 38 on leg 39 and bar 38*a* on leg 39*a* each move two switches, the former the switches 32–33 and the latter the switches 30–31.

The back edge of leg 39 (when moved) is engaged by notch 40 of the portion 41 of arm 42 which is pivotally mounted as at 43 and is biassed by a spring 44. The result is that lug 45 on arm 42 is brought into the path of strikers 46 on the drum 47.

Returning now to FIG. 9, the switch 30 is now at the b terminal, the switch 31 is at the open condition disconnecting power to solenoid 19, the switch 32 is at the b terminal and the switch 33 is at the b terminal. This means that there is power to switch 54 which is open due to the raised condition of the bar 20.

With a ticket now exposed such information as is required is written on the ticket in the window 4. After this step the handle 2 is moved to bring a lug 2*a* against plate 35 to cause the slide 5 to move to its closed position and at the same time withdraw bar 26 from hole 25. Upon release of the handle the end of the bar 26 is urged against the bar 20 by the counter weight due to the fact that the bar 20 when released from the bar 26 is retracted by spring 21. The retraction of bar 20 changes the switch 54 from open condition to closed condition, as illustrated in the circuit diagram. This provides a path for power to switches 55 and 32 and through them to the clamp release solenoid 53, the brake solenoid 52 and the drum motor 51. The solenoid 53 through linkage 53*a* moves a clamp plate 53*b* (which serves as a support when a user writes on a ticket) and which is mounted in supports 53*c* to release the duplex strip of tickets and duplicates. Solenoid 52 releases a band brake on the shaft of motor 51 thereby enabling 47 to be rotated by the motor 51.

In the next mechanical step with the feed drum indexed by motor 51 the ticket on which information has just been written together with its duplicate are moved out of the window 4. This movement of drum 47 brings striker 46 into engagement with lug 45 on arm 42, arm 42 pivots to compress spring 44 and notch 40 is disengaged from the leg 39. Bar 38 releases switches 32 and 33 which change back to their original condition. Step 47 on the bar 38*a* remains engaged with a rib 48 on a spring arm 49 of a solenoid 50 to retain switches 30 and 31 operated.

As drum 47 rotates a switch 55 is operated by a notch 56 in the periphery of the drum 47 to maintain power to the clamp 53, brake 52 and motor 51 when switch 32 returns to its original position at terminal c.

When the switch 55 returns to the c terminal after passing over the notch 56 power to the motor 51, brake 52 and clamp 53 is interrupted and the drum 47 stops rotating. Power is at the same time switched to the guillotine solenoid 57 and the counter 58 because switch 30 is still in the "on" position and the switch 54 is in the closed condition due to the bar 20 having retracted and the switch 32 is in the position illustrated connecting terminals a and c. The guillotine linkage 57*a* (see FIGS. 4 and 6) is actuated by guillotine solenoid 57 to cause a cutter bar 57*b* with a slot through it which permits a ticket "T" to pass through the bar 57*b*, to guillotine the ticket "T" between an edge of the slot and blade 57*c* which is urged against the periphery of the bar 57*b* by spring 57*d*. The ticket issues through the chute 6 and the duplicate passes with the previous duplicates in a spring to a storage drum. The linkage 57*a* when moved by the solenoid 57 actuates switch 59 which moves to the b terminal and the solenoid 50 is energized to release notch 47 from bar 48 and the switches 30 and 31 return to their original condition. Actuation of switch 59 to terminal b disconnects power to relay 16 and the machine with all its mechanical and electrical functions completed is in the stand-by condition as originally described. In this condition switches 13 and 14 are activated due to the presence of paper being fed to the window and duplicates being fed to the rewind drum 61*b*. Switches 62 and 63 are in the position illustrated due to the last original and last duplicate tickets not having reached the detectors of switches 62 and 63 and solenoid 17 is again energised to maintain the coin deflect finger retracted.

The rewinding of the tickets onto the duplicate drum 61*b* is best seen in FIG. 4. The duplicate strip passes around rollers 64 to 67 and roller 66 is a floating roller movable up and down in the slot 69. A pivotted bracket 70 is "overcenter" biassed by spring 68 so that as roller 66 falls and rises a "snap action" of bracket 70 gives a sharp "on" or "off" action to switch 71 which controls the power to the motor 72. When the take-up drum 61*b* has wound on sufficient duplicate strip switch 71 is operated by the rising of the bracket 70 and the motor 72 is de-energized.

Looking now at the safety aspects of the machine and the results of any operational faults detected in the operation of the machine. In the event of switch 13 detecting a break in the feed of duplicates to the rewind drum 61*b* the power supply to switch 14 would be interrupted due to switch 13 changing over to terminal c. This would result in the interruption of the power supply to the cabinet lights and the supply of power to the service light which would indicate a "SOLD OUT" condition for the machine to discourage any further attempt to operate the machine. At the same time power to the relay 16 would be interrupted and the coin deflect finger would again become operative to deflect any coins which were fed to the machine back to the discharge chute 3*b*. The same situation would occur if switch 14 detected a mis-feed of originals and duplicates to the window 4. When a condition is reached that the last original or last duplicate ticket has reached a detection point switches 63 or 62 will switch over from the b terminal to the c terminal and consideration of the circuit diagram will show that the same machine conditions will prevail. The cabinet lights will be extinguished, the "SOLD OUT" sign will be illuminated and the coin deflect finger will again become operative. However under these circumstances the power supply from switch 14 (a and b) is maintained to complete the already initiated sequence, to advance and guillotine the ticket.

Trouble could result if the switch 32 does not cancel. If this was to happen without safe-guards being incorporated into the electrical apparatus there would be a continuous supply of current to the index motor 51 the brake 52 and the clamp 53 which would result in the issuance of a string of original tickets from the machine for a single coin credit. This possibility is avoided by means of the switch 33 and the switches 61 and 61*a*. The switches 32 and 33 work together and when mechanically activated both move from terminal c to terminal b. Switch 61 is normally open and switch 61*a* is normally closed which means that when switch 33 goes to terminal b there is still a continuous flow of current through switch 61*a* to operate the various devices of the machine. Power also goes through switch 33 from terminal a to terminal b to switch 61 which because it is open circuit condition does not pass current. In the event that switches 32 and 33 do not drop back to the "off" position when released by the bar 38 the switches 61 and 61*a* when actuated by engaging in depressions in the periphery of the drum 47 reverse their conditions, switch 61 is closed and current will then flow through terminal a and b of switch 33 through switch 61 to the "SOLD OUT" sign indicating that the machine is inoperative. Simultaneously switch 61*a* is opened and interrupts any flow of current to the various components of the machine and the machine stops. At the same time the cabinet lights are extinguished and there is no power to relay 16 which allows the coin reject finger to return to operative position to return coins fed to the machine which can only be reactivated by the attendance of a service man who must correct the situation which prevented switches 32 and 33 returning to the unactivated position.

I claim:

1. A coin controlled and record keeping ticket issuing machine comprising a housing in which there is a coin credit establishing means, an electrically initiated mechanical catch means activated by the establishment of the coin credit to release a counterweighted slide thereby allowing the slide to move under the influence of its counterweight from its normal position covering a support surface for tickets to be written on to a position exposing said support surface, said slide in moving from its normal position creating power circuits for feed means and ticket severing means to be subsequently energized, manual means on the housing to return the slide to its normal position and to re-engage said catch means, first control means activated by the return of the slide to its normal position to temporarily activate said feed means to advance a strip laminate of original and duplicate tickets in order to locate a new ticket with duplicate over said support surface and locate the preceding now written on original ticket in operative relationship to a ticket severing and issuing means, second control means activated by the completion of the ticket advancing operation of the feed means to sever and issue said preceding original ticket and third control means activated by slack in the advancing strip of duplicate tickets to temporarily activate a duplicate ticket storage means.

2. A machine as claimed in claim 1 wherein after the establishment of a coin credit each machine function has to be completed before a following machine function can commence.

3. A machine as claimed in claim 1 wherein the first control means comprises switch means to direct power to said feed means which is an electrically operated mechanical arrangement, said switch means comprising a primary switch assembly which is actuated upon slide opening movement and a secondary switch assembly which is actuated by said catch means being returned to its rest position as a result of the slide returning to its normal position, said switch means being deactivated upon the completion of a feeding cycle by mechanical release of portion of the primary switch assembly.

4. A machine as claimed in claim 3 wherein the second control means comprises a further switch means which is momentarily switched over during operation of the feed means from a circuit to the feed means which includes said portion of said primary switch means before release thereof so as to directly supply power to the feed means and which after the release of said portion of the primary switch assembly is switched back by the operation of the feed means to open circuit the feed means, said portion of the primary switch assembly when released completing a power supply to electrically operated ticket guillotining means.

5. A machine as claimed in claim 4 wherein said third control means is a pressure operated switch which is normally open circuit to a motor control rotatable drum on which duplicate tickets are wound, pressure is applied thereto to close a circuit to the motor of the drum upon slack occuring in a strip of duplicate tickets resulting from the operation of the feed means.

* * * * *

UNITED STATES PATENT AND TRADEMARK OFFICE

CERTIFICATE OF CORRECTION

PATENT NO. : 4,135,613

DATED : January 23, 1979

INVENTOR(S) : MARQUIS ANTHONY JACKSON

It is certified that error appears in the above-identified patent and that said Letters Patent are hereby corrected as shown below:

Abstract, line 4, "macine" should read --machine--.

Column 1, line 32, "s" should read --stored by storage--.

Column 2, line 53, after "original" insert --and--.

Signed and Sealed this

*First* Day of *May 1979*

[SEAL]

*Attest:*

RUTH C. MASON
*Attesting Officer*

DONALD W. BANNER
*Commissioner of Patents and Trademarks*